US011390487B2

(12) United States Patent
Tracey et al.

(10) Patent No.: US 11,390,487 B2
(45) Date of Patent: Jul. 19, 2022

(54) AUTOMATED ELEVATOR SAFETY CHAIN DIAGNOSIS

(71) Applicant: OTIS ELEVATOR COMPANY, Farmington, CT (US)

(72) Inventors: Michael J. Tracey, Cromwell, CT (US); Leslie C. Watterson, Unionville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 994 days.

(21) Appl. No.: 16/106,279

(22) Filed: Aug. 21, 2018

(65) Prior Publication Data

US 2020/0062543 A1 Feb. 27, 2020

(51) Int. Cl.
*B66B 5/00* (2006.01)
*B66B 1/28* (2006.01)
(Continued)

(52) U.S. Cl.
CPC ..... *B66B 5/0025* (2013.01); *B66B 1/28* (2013.01); *B66B 5/02* (2013.01); *B66B 13/125* (2013.01); *B66B 13/185* (2013.01)

(58) Field of Classification Search
CPC ..... B66B 5/0025; B66B 1/28; B66B 5/02; B66B 13/125; B66B 13/185;
(Continued)

(56) References Cited

U.S. PATENT DOCUMENTS 6,446,759 B1 * 9/2002 Kulak ..... B66B 13/12 187/319
8,602,171 B2 12/2013 Vogl
(Continued)

FOREIGN PATENT DOCUMENTS

CN 105270973 B 12/2017
DE 112011105684 T5 7/2014
(Continued)

OTHER PUBLICATIONS

Inspection service (INS) / Elevator Wiki/ FANDPOM powered by Wilia; 4 pages; http://elevation.wikia.com/wiki/Inspection_service_(INS) dated Jul. 11, 2018.
(Continued)

*Primary Examiner* — Jeffrey Donels
(74) *Attorney, Agent, or Firm* — Carlson, Gaskey & Olds, P.C.

(57) ABSTRACT

An illustrative example embodiment of an elevator system includes an elevator car situated for movement among a plurality of landings. The elevator car includes a car door and a door mover. A door interlock associated with a landing door at each of the landings is configured to couple the associated landing door with the car door. The door interlocks respectively include a lock switch. A controller is configured to: cause the elevator car to move to at least one of the landings; when the elevator car is at the at least one landing, cause the door mover to instigate movement of the door interlock sufficient to at least temporarily change a position of the lock switch; and locate a malfunctioning one of the lock switches at one of the landings based on the movement of the door interlock.

24 Claims, 2 Drawing Sheets

(51) Int. Cl.
*B66B 5/02* (2006.01)
*B66B 13/12* (2006.01)
*B66B 13/18* (2006.01)

(58) Field of Classification Search
CPC ..... B66B 5/0093; B66B 13/22; B66B 5/0031; B66B 13/12; B66B 13/06
See application file for complete search history.

(56) References Cited

U.S. PATENT DOCUMENTS

| | | | | |
|---|---|---|---|---|
| 8,941,964 | B2 | 1/2015 | Madar | |
| 2016/0009526 | A1 | 1/2016 | Mertala et al. | |
| 2018/0079621 | A1 | 3/2018 | Fauconnet et al. | |
| 2018/0079622 | A1 | 3/2018 | Sirigu et al. | |
| 2018/0086605 | A1 | 3/2018 | Saarela et al. | |
| 2018/0118514 | A1* | 5/2018 | Bruno | B66B 5/0012 |
| 2018/0127243 | A1 | 5/2018 | Fauconnet et al. | |
| 2018/0162689 | A1* | 6/2018 | Kim | B66B 13/16 |
| 2018/0265334 | A1* | 9/2018 | Kulak | B66B 13/20 |
| 2018/0327220 | A1* | 11/2018 | Fauconnet | B66B 13/16 |
| 2019/0300337 | A1* | 10/2019 | Lindegger | B66B 5/0031 |

FOREIGN PATENT DOCUMENTS

| | | | |
|---|---|---|---|
| EP | 2927174 | A1 | 7/2015 |
| GB | 2110388 | A | 6/1983 |
| JP | 2012188199 | A | 10/2012 |
| WO | 2018/010991 | A1 | 1/2018 |

OTHER PUBLICATIONS

Bob Desnoyers Elevator & Escalator Inspections, Inc.; Update #13 Contactors & Relays for Use in Critical Operating Circuits (2.26.3); 4 pages; http://www.elevatorbob.com/u13.html; dated Jul. 11, 2018.
Extended European Search Report for Application No. EP 19 19 2929 dated Mar. 18, 2020.

* cited by examiner

AUTOMATED ELEVATOR SAFETY CHAIN DIAGNOSIS

BACKGROUND

Elevator systems include various features to protect individuals on or near an elevator. For example, the landing doors at each landing are locked whenever the elevator car is not situated at that landing to prevent access to the hoistway. The door locks include switches that provide an indication whether the door is locked. A controller will typically prevent the elevator car from moving when any of the switches indicates that any of the landing doors is open or not locked.

One issue with known door lock components is that they may become misaligned or wear over time, either of which can cause the associated switch to malfunction. If any of the switches along a hoistway is not properly working the elevator car in that hoistway is taken out of service. A service technician or mechanic typically has to manually inspect each door to identify which switch is not working properly because the switches are all connected in series. Such manual inspection takes time especially in high rise buildings.

SUMMARY

An illustrative example embodiment of an elevator system includes an elevator car situated for movement among a plurality of landings. The elevator car includes a car door and a door mover. A door interlock associated with a landing door at each of the landings is configured to couple the associated landing door with the car door. The door interlocks respectively include a lock switch. A controller is configured to: cause the elevator car to move to at least one of the landings; when the elevator car is at the at least one landing, cause the door mover to instigate movement of the door interlock sufficient to at least temporarily change a position of the lock switch; and locate a malfunctioning one of the lock switches at one of the landings based on the movement of the door interlock.

In an example embodiment having one or more features of the elevator system of the previous paragraph, an amount of movement of the door mover that instigates the movement of the door interlock is insufficient to cause movement of the landing door at the selected landings.

In an example embodiment having one or more features of the elevator system of any of the previous paragraphs, the lock switches are supposed to be in a closed condition when the respective associated landing doors are closed and the malfunctioning one of the lock switches is in an open condition when the associated landing door is closed prior to the instigated movement of the door interlock.

In an example embodiment having one or more features of the elevator system of any of the previous paragraphs, the lock switches are connected in series in an electrically conductive circuit, when any of the lock switches is open the electrically conductive circuit is an open circuit, and the controller locates the malfunctioning one of the lock switches at one of the selected landings by determining when the electrically conductive circuit changes from an open circuit to a closed circuit responsive to the movement of the door interlock at the one of the selected landings.

In an example embodiment having one or more features of the elevator system of any of the previous paragraphs, the movement of the door interlock is sufficient to cause the malfunctioning lock switch to move into the closed condition.

In an example embodiment having one or more features of the elevator system of any of the previous paragraphs, the door interlocks each include a lock member, the lock switches each include a contact that moves with the lock member, and the movement of the door interlock instigated by the door mover is sufficient to cause movement of the lock member.

In an example embodiment having one or more features of the elevator system of any of the previous paragraphs, the lock member is moveable between a locked position and an unlocked position and the movement of the door interlock instigated by the door mover moves the lock member in a direction from the locked position toward the unlocked position.

In an example embodiment having one or more features of the elevator system of any of the previous paragraphs, the lock member moves into the locked position subsequent to the movement of the door interlock instigated by the door mover and the lock switch contact member moves into a position to close the lock switch as the lock member moves into the locked position.

In an example embodiment having one or more features of the elevator system of any of the previous paragraphs, the controller sequentially moves the elevator car from one of the landings to an adjacent one of the landings until the controller locates the malfunctioning lock switch or the elevator car has moved to all of the plurality of landings.

In an example embodiment having one or more features of the elevator system of any of the previous paragraphs, the controller determines whether the elevator car is empty before moving the elevator car and the controller only moves the elevator car when the elevator car is empty or an authorized override command has been provided to the controller to move the elevator car when the elevator car is not empty.

In an example embodiment having one or more features of the elevator system of any of the previous paragraphs, the controller stores an indication of the location of the malfunctioning one of the lock switches or provides the indication to another device accessible by an authorized individual.

In an example embodiment having one or more features of the elevator system of any of the previous paragraphs, the controller is configured to respond to a command from a location remote from a site of the elevator system by causing the elevator car to move and the door mover to instigate movement of the door interlocks to locate the malfunctioning lock switch prior to a technician arriving at the site of the elevator system.

An illustrative example embodiment of a method of analyzing an elevator system safety chain includes: moving an elevator car to at least one of a plurality of landings; instigating movement of a door interlock at the at least one of the landings sufficient to at least temporarily change a position of a lock switch at the at least one of the landings when the elevator car is at the at least one of the landings; and locating a malfunctioning lock switch at one of the landings based on the movement of the door interlock sufficient to at least temporarily change the position of the lock switch.

An example embodiment having one or more features of the method of the previous paragraph includes instigating the movement of the door interlock using a door mover of the elevator car and wherein an amount of movement of the door mover that instigates the movement of the door interlock is insufficient to cause movement of a landing door associated with the door interlock.

In an example embodiment having one or more features of the method of any of the previous paragraphs, there are a plurality of lock switches, one of the lock switches is at each of the landings, the lock switches are supposed to be in a closed condition when respective associated landing doors are closed, and the malfunctioning lock switch is in an open condition when the associated landing door is closed prior to the movement of the door interlock.

In an example embodiment having one or more features of the method of any of the previous paragraphs, the lock switches are connected in series in an electrically conductive circuit, when any of the lock switches is open the electrically conductive circuit is an open circuit, and locating the malfunctioning one of the lock switches comprises determining when the electrically conductive circuit changes from an open circuit to a closed circuit responsive to the movement of the door interlock at the one of the selected landings.

In an example embodiment having one or more features of the method of any of the previous paragraphs, the movement of the door interlock is sufficient to cause the malfunctioning lock switch to move into the closed condition.

In an example embodiment having one or more features of the method of any of the previous paragraphs, the door interlock includes a lock member, the lock switch includes a contact that moves with the lock member, and the movement of the door interlock is sufficient to cause movement of the lock member.

In an example embodiment having one or more features of the method of any of the previous paragraphs, the lock member is moveable between a locked position and an unlocked position and instigating movement of the door interlock comprises moving the lock member in a direction from the locked position toward the unlocked position.

In an example embodiment having one or more features of the method of any of the previous paragraphs, the lock member moves into the locked position subsequent to the movement of the door interlock and the lock switch contact member moves into a position to close the lock switch as the lock member moves into the locked position.

An example embodiment having one or more features of the method of any of the previous paragraphs includes sequentially moving the elevator car from one of the landings to an adjacent one of the landings until locating the malfunctioning lock switch or the elevator car has moved to all of the plurality of landings.

An example embodiment having one or more features of the method of any of the previous paragraphs includes determining whether the elevator car is empty before moving the elevator car and only moving the elevator car when the elevator car is empty or an authorized override command has been provided to move the elevator car when the elevator car is not empty.

An example embodiment having one or more features of the method of any of the previous paragraphs includes storing an indication of the location of the malfunctioning one of the lock switches or providing the indication to another device accessible by an authorized individual.

An example embodiment having one or more features of the method of any of the previous paragraphs includes responding to a command from a location remote from a site of the elevator system by moving the elevator car to the landings, instigating movement of the door interlocks at the landings, respectively, and locating the malfunctioning lock switch prior to a technician arriving at the site of the elevator system.

The various features and advantages of at least one disclosed example embodiment will become apparent to those skilled in the art from the following detailed description. The drawings that accompany the detailed description can be briefly described as follows.

DETAILED DESCRIPTION

Embodiments of this invention facilitate diagnosing a condition of an elevator safety chain and locating a malfunctioning switch in the safety chain in an efficient manner.

Figure 1:
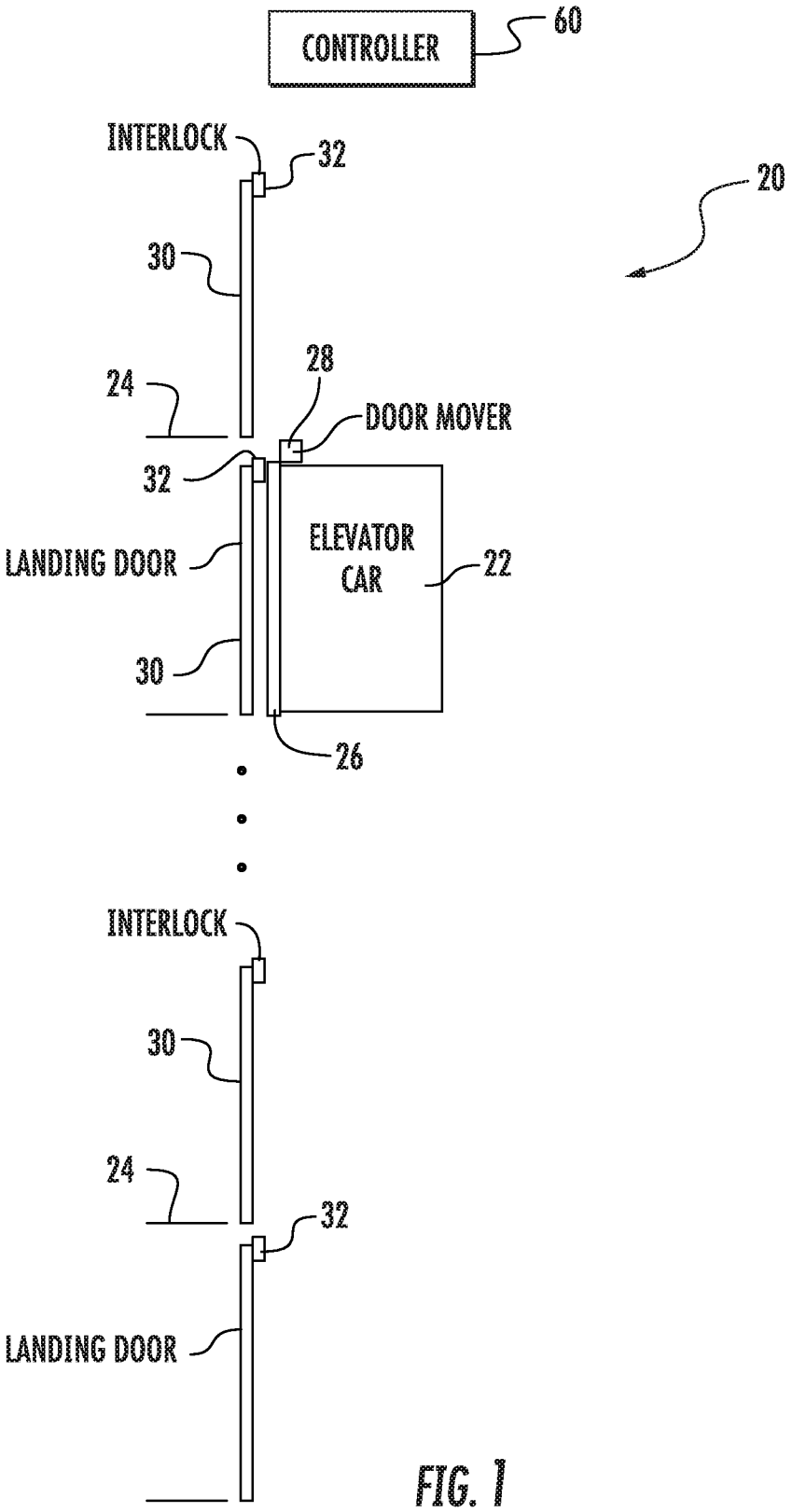
FIG. 1 schematically illustrates selected portions of an elevator system.

FIG. 1 schematically illustrates selected portions of an elevator system 20. An elevator car 22 is situated for movement among a plurality of landings 24. The elevator car 22 includes at least one elevator door 26 that is moveable between open and closed positions by a door mover 28.

At least one landing door 30 is situated at each of the landings 24. An interlock 32 associated with each of the landing doors 30 facilitates coupling the elevator car door 26 to the landing door 30 when the elevator car 22 is situated at one of the landings 24 so that the doors 26 and 30 move together when the elevator car 22 is at a particular landing.

Figure 2:
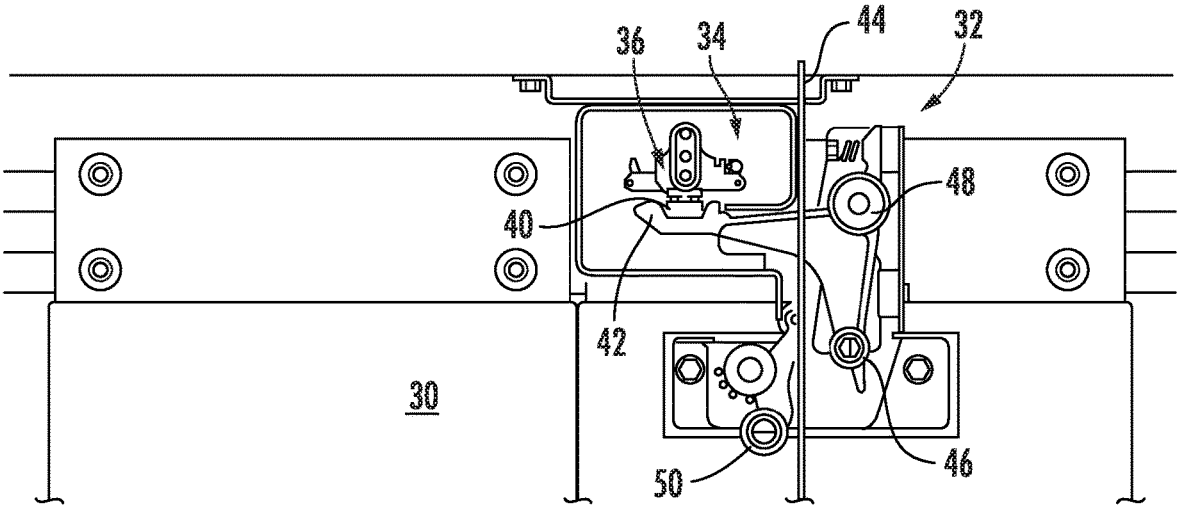
FIG. 2 schematically illustrates an example door interlock arrangement.

As shown in FIG. 2, an example door interlock 32 includes a door lock 34 and a lock switch 36. The lock switch 36 includes a switch contact 40 that is supported on a lock member 42. When the associated landing doors 30 are in a fully closed position, the lock member 42 is biased into a closed or locked position where the switch contact 40 closes the switch 36.

When the elevator car 22 is properly situated at a landing and the elevator car door 26 is aligned with the landing door 30, a vane 44 supported on the elevator car door 26 and the interlock 32 cause the landing doors 30 to move with the elevator car doors 26 responsive to operation of the door mover 28. In the illustrated example embodiment, the vane 44 contacts a roller 46 to pivot the lock member 42 downward (according to the drawing) to unlock the door lock 34. In that condition, the switch 36 is open because the switch contact 40 no longer makes electrical contact with the rest of the switch 36. Rollers 48 and 50 cooperate with the vane 44 for moving the landing doors 30 between open and closed positions. Other types of interlocks are known and embodiments of this invention are not limited to any particular interlock configuration.

The lock switches 36 at each of the landings 24 are connected in series to form an electrical circuit or safety chain in a known manner. A controller 60 (shown in FIG. 1) monitors the condition of the safety chain to determine whenever any of the lock switches 36 indicates that an associated door lock 34 is not in the locked condition, which typically corresponds to an associated landing door 30 being open. The controller 60 is programmed or configured to prevent movement of the elevator car 22 whenever the safety chain electrical circuit is an open circuit because at least one of the lock switches 36 is open.

One issue associated with many elevator door interlock configurations is that precise alignment among the components is required for the lock switch 36 to operate properly. Additionally, wear and tear on the components over time may interfere with proper function of the lock switch 36 at any of the landings 24. The controller 60 is configured to diagnose a condition of the safety chain by locating a malfunctioning one of the lock switches 36, which can be accomplished in partially or fully automated manner.

Assuming that at least one of the lock switches 36 is in an open condition when it is supposed to be closed while the associated landing doors 30 are closed, the elevator car 22 will be taken out of service by the controller 60 because the safety chain does not indicate proper door conditions along an entire hoistway. Under those circumstances, the controller 60 is configured to automatically diagnose a condition of at least some of the interlocks 32 and their associated lock switches 36 to locate the malfunctioning lock switch 36.

Figure 3:
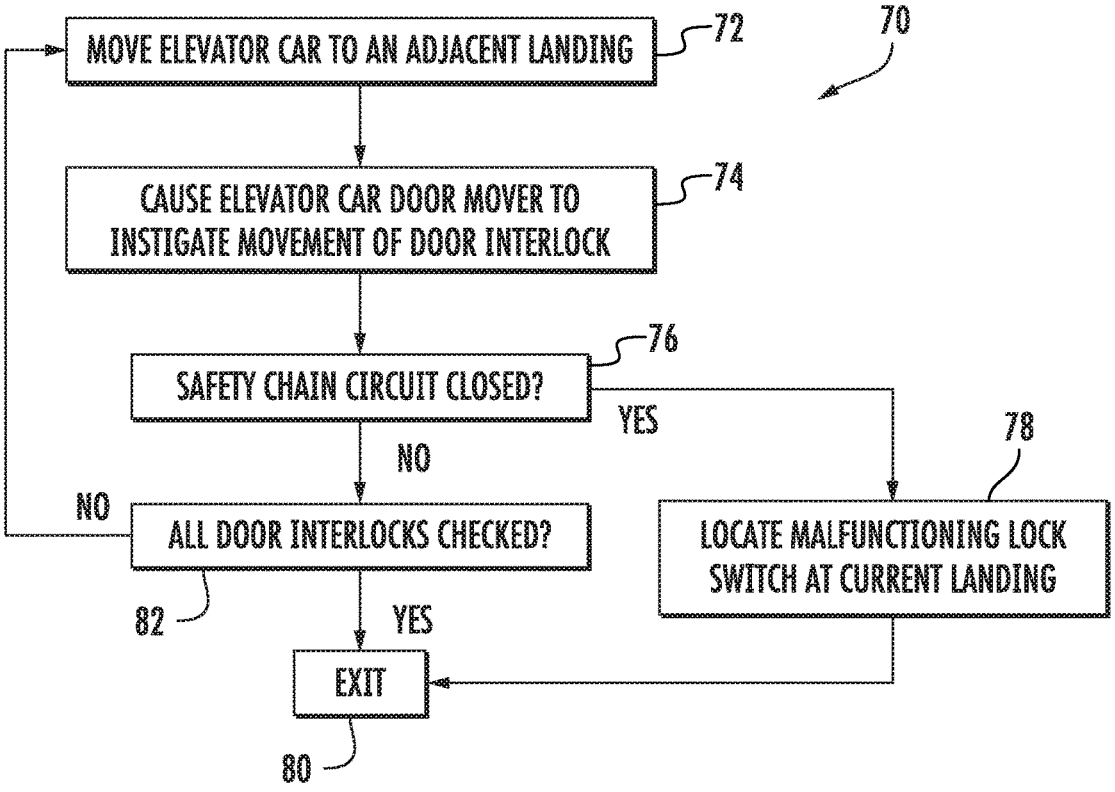
FIG. 3 is a flow chart diagram summarizing an example method of locating a malfunctioning switch in the elevator system shown in FIG. 1.

FIG. 3 shows a flowchart diagram 70 that summarizes an example approach for diagnosing the safety chain of the elevator system 20. The example technique is useful, for example, when at least one of the lock switches 36 is malfunctioning leaving the safety chain in an open circuit condition. In some example embodiments, the controller 60 operates in a maintenance or inspection mode that includes an ability to bypass the open circuit condition of the safety chain to allow elevator car movement even though at least one of the lock switches 36 is not in a fully closed condition.

At 72, the controller 60 moves the elevator car 22 to one of the landings 24. In some embodiments the controller 60 first determines that the elevator car is empty before commencing movement of the elevator car 22. The load on the elevator car 22 or video information regarding the interior of the car, which can be obtained in a known manner, provides an indication whether the elevator car 22 is empty. In some cases, a mechanic or technician may want to be in the elevator car 22 during the example procedure and some embodiments accommodate this by including an override option for the mechanic to indicate to the controller 60 that moving the elevator car 22 while the mechanic is in the car is desired. This could be incorporated into an inspection mode command, for example.

While the elevator car 22 is situated at that landing, the controller 60 causes the door mover 28 to instigate movement of the door interlock 32. For example, the controller 60 may cause the door mover 28 to move the elevator car door 26 and the associated vane 44 sufficiently to contact the roller 46 to pivot the lock member 42 from the locked position shown in FIG. 2 toward an unlocked position. The door mover 28 then returns to a rest or initial position allowing the lock member 42 to return to the locked position. Such movement can tend to cause the switch contact 40 to make proper contact with the remainder of the switch 36 to close the switch. If the switch 36 was malfunctioning, such movement of the door mover 28 to instigate some movement of the interlock 32 can effectively at least temporarily restore the switch 36 to a properly closed condition, which completes or closes the circuit of the safety chain.

The amount of movement of the door mover 28 is sufficient to cause some movement of the components of the interlock 32 without causing movement of the landing doors 30. Many elevator door interlock arrangements are designed so that there is some movement of the interlock components to unlock the door, for example, prior to any movement of the landing doors 30. Using such a small amount of movement of the door mover 28 facilitates keeping the hoistway doors 30 closed so as not to disturb or alert anyone who may be near a landing 24 where the elevator car 22 is situated.

At 76, the controller 60 determines whether the safety chain circuit has closed as a result of the instigated movement of the interlock 32. If the safety chain circuit is now a closed circuit, that indicates that the switch 36 at that landing 24 was the one causing the open safety chain circuit condition. In other words, the switch 36 at that landing 24 is the malfunctioning switch. At 78, the controller 60 locates the malfunctioning lock switch 36 at the current landing 24 where the elevator car 22 is positioned. The controller 60 is aware of the location of the elevator car 22 using known techniques.

Once the malfunctioning lock switch has been located, the controller 60 stores or provides an indication of that information so that it is accessible by a mechanic who can address the condition of the interlock 32 and the lock switch 36 at the appropriate landing 24. At 80, the controller 60 exits the automated diagnosis mode.

In many instances, the elevator car 22 will have to travel to multiple landings 24 before a malfunctioning lock switch will be located. The example technique summarized in FIG. 3 includes continuing to move the elevator car 22 to an adjacent landing 24 as long as all of the door interlocks 32 have not yet been checked as shown at 82. Since the controller 60 may locate or identify the malfunctioning lock switch 34 before checking every interlock at every one of the landings 24, only a selected subset of the landings 24 may be involved in a particular diagnostic procedure.

In some example embodiments, the controller 60 is configured to receive a command to perform the automated diagnosis from a remote location. For example, a mechanic or technician traveling to the site of the elevator system 20 may use a communication device, such as a mobile phone, to send a signal or command to the controller 60 to locate the malfunctioning lock switch 36. The controller 60 automatically locates the malfunctioning lock switch and either communicates that information to the device that issued the command or stores that information in a manner that is accessible to the technician or mechanic once that individual arrives at the site of the elevator system 20.

In some example embodiments, the controller 60 automatically instigates the diagnosis procedure based on detecting that there is a fault in the safety chain. For example, when the controller 60 determines that the safety chain indicates that at least one door is not locked when all doors are expected to be locked, the controller 60 conducts the process summarized in FIG. 3. The information regarding the located malfunctioning lock switch 36 may be stored by the controller 60, communicated to a remote device for access by a technician or mechanic, or both.

While the above technique is described as being useful for locating a malfunctioning lock switch, the diagnosis technique identifies a malfunctioning interlock 32 or door lock 34 that may require repair or adjustment because the condition and operation of those components affects the ability of the lock switch 36 to properly close to complete or close the circuit of the safety chain.

By automating the diagnosis of the safety chain and interlocks, it is no longer necessary for a mechanic or technician to manually inspect each of them to locate which of the lock switches 36 is malfunctioning. The automated diagnosis of an embodiment of this invention improves efficiencies associated with elevator system maintenance and restoring an elevator to service.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

an elevator car situated for movement among a plurality of landings, the elevator car including a car door and a door mover;

a landing door at each of the landings;

a door interlock associated with the landing door at each of the landings, the door interlocks being configured to couple the associated landing door with the car door, the door interlocks respectively including a lock switch; and a controller configured to:

cause the elevator car to move to at least one selected landing of the plurality of landings;

when the elevator car is at the at least one selected landing, cause the door mover to instigate movement of the door interlock sufficient to at least temporarily change a position of the lock switch at the at least one selected landing; and locate a malfunctioning one of the lock switches at one of the landings based on the movement of the door interlock.

2. The elevator system of claim 1, wherein an amount of movement of the door mover that instigates the movement of the door interlock is insufficient to cause movement of the landing door at the at least one selected landing.

3. The elevator system of claim 1, wherein the lock switches are supposed to be in a closed condition when the respective associated landing doors are closed; and the malfunctioning one of the lock switches is in an open condition when the associated landing door is closed prior to the instigated movement of the door interlock.

4. The elevator system of claim 3, wherein the lock switches are connected in series in an electrically conductive circuit;

when any of the lock switches is open the electrically conductive circuit is an open circuit; and the controller locates the malfunctioning one of the lock switches at the at least one selected landing by determining when the electrically conductive circuit changes from an open circuit to a closed circuit responsive to the movement of the door interlock at the at least one selected landing.

5. The elevator system of claim 3, wherein the movement of the door interlock is sufficient to cause the malfunctioning lock switch to move into the closed condition.

6. The elevator system of claim 1, wherein the door interlocks each include a lock member;

the lock switches each include a contact that moves with the lock member; and the movement of the door interlock instigated by the door mover is sufficient to cause movement of the lock member.

7. The elevator system of claim 6, wherein the lock member is moveable between a locked position and an unlocked position; and the movement of the door interlock instigated by the door mover moves the lock member in a direction from the locked position toward the unlocked position.

8. The elevator system of claim 7, wherein the lock member moves into the locked position subsequent to the movement of the door interlock instigated by the door mover; and the lock switch contact member moves into a position to close the lock switch as the lock member moves into the locked position.

9. The elevator system of claim 1, wherein the controller sequentially moves the elevator car from the at least one selected landing to an adjacent one of the landings until the controller locates the malfunctioning one of the lock switches or the elevator car has moved to all of the plurality of landings.

10. The elevator system of claim 9, wherein the controller determines whether the elevator car is empty before moving the elevator car; and the controller only moves the elevator car when the elevator car is empty or an authorized override command has been provided to the controller to move the elevator car when the elevator car is not empty.

11. The elevator system of claim 1, wherein the controller stores an indication of the location of the malfunctioning one of the lock switches; or provides the indication to another device accessible by an authorized individual.

12. The elevator system of claim 1, wherein the controller is configured to respond to a command from a location remote from a site of the elevator system by causing the elevator car to move and the door mover to instigate movement of the door interlocks to locate the malfunctioning lock switch prior to a technician arriving at the site of the elevator system or determine that there is a fault condition based on at least one of the lock switches and automatically cause the elevator car to move and the door mover to instigate movement of the door interlocks based on the determination that there is a fault.

13. A method of analyzing an elevator system safety chain, the method comprising:

moving an elevator car to at least one of a plurality of landings;

instigating movement of a door interlock at the at least one of the landings sufficient to at least temporarily change a position of a lock switch at the at least one of the landings when the elevator car is at the at least one of the landings; and locating a malfunctioning lock switch at one of the landings based on the movement of the door interlock sufficient to at least temporarily change the position of the lock switch.

14. The method of claim 13, comprising instigating the movement of the door interlock using a door mover of the elevator car and wherein an amount of movement of the door mover that instigates the movement of the door interlock is insufficient to cause movement of a landing door associated with the door interlock.

15. The method of claim 13, wherein there are a plurality of lock switches;

one of the lock switches is at each of the landings;

the lock switches are supposed to be in a closed condition when respective associated landing doors are closed; and the malfunctioning lock switch is in an open condition when the associated landing door is closed prior to the movement of the door interlock.

16. The method of claim 15, wherein the lock switches are connected in series in an electrically conductive circuit;

when any of the lock switches is open the electrically conductive circuit is an open circuit; and locating the malfunctioning lock switch comprises determining when the electrically conductive circuit changes from an open circuit to a closed circuit responsive to the movement of the door interlock at the at least one of the landings.

17. The method of claim 15, wherein the movement of the door interlock is sufficient to cause the malfunctioning lock switch to move into the closed condition.

18. The method of claim 13, wherein the door interlock includes a lock member;

the lock switch includes a contact that moves with the lock member; and the movement of the door interlock is sufficient to cause movement of the lock member.

19. The method of claim 18, wherein the lock member is moveable between a locked position and an unlocked position; and instigating movement of the door interlock comprises moving the lock member in a direction from the locked position toward the unlocked position.

20. The method of claim 19, wherein the lock member moves into the locked position subsequent to the movement of the door interlock; and the lock switch contact member moves into a position to close the lock switch as the lock member moves into the locked position.

21. The method of claim 13, comprising sequentially moving the elevator car from the at least one of the landings to an adjacent one of the landings until locating the malfunctioning lock switch or the elevator car has moved to all of the plurality of landings.

22. The method of claim 21, comprising determining whether the elevator car is empty before moving the elevator car; and only moving the elevator car when the elevator car is empty or an authorized override command has been provided to move the elevator car when the elevator car is not empty.

23. The method of claim 21, comprising storing an indication of the location of the malfunctioning lock switch; or providing the indication to another device accessible by an authorized individual.

24. The method of claim 13, comprising responding to a command from a location remote from a site of the elevator system by moving the elevator car to the landings, instigating movement of the door interlocks at the landings, respectively, and locating the malfunctioning lock switch prior to a technician arriving at the site of the elevator system or determining that there is a fault condition based on at least one of the lock switches and, based on the determination that there is a fault, automatically moving the elevator car to the landings, instigating movement of the door interlocks at the landings, respectively, and locating the malfunctioning lock switch.

* * * * *